US005162636A

United States Patent [19]

Randolph, Jr. et al.

[11] Patent Number: 5,162,636

[45] Date of Patent: Nov. 10, 1992

[54] ELECTRIC COOKING MEANS

[75] Inventors: George J. J. Randolph, Jr., Newnan, Ga.; Felix Schreder, Oberderdingen, Fed. Rep. of Germany

[73] Assignee: E.G.O. Elektro-Gerate Blanc u. Fischer, Fed. Rep. of Germany

[21] Appl. No.: 642,657

[22] Filed: Jan. 17, 1991

Related U.S. Application Data

[63] Continuation-in-part of Ser. No. 466,513, Jan. 17, 1990, abandoned.

[30] Foreign Application Priority Data

Apr. 19, 1990 [DE] Fed. Rep. of Germany ..... 9004485

[51] Int. Cl.[5] ..... H05B 3/70

[52] U.S. Cl. ..... 219/453; 219/464; 219/506

[58] Field of Search ..... 219/453, 506, 464, 465

[56] References Cited

U.S. PATENT DOCUMENTS

| | | | |
|---|---|---|---|
| 1,699,737 | 1/1929 | Hicks . | |
| 2,346,237 | 4/1944 | Rutenber . | |
| 2,492,100 | 12/1949 | Kitson . | |
| 2,659,069 | 11/1953 | Kinsella . | |
| 2,870,316 | 1/1959 | Ferguson, Jr. . | |
| 3,067,315 | 12/1962 | Hurko . | |
| 3,944,786 | 3/1976 | Detterbeck | 219/453 |
| 4,518,850 | 5/1985 | Grasso | 219/506 |
| 4,611,112 | 9/1986 | Schreder | 219/464 |
| 4,990,751 | 2/1991 | Martel | 219/453 |
| 5,013,893 | 5/1991 | Goessler | 219/453 |

FOREIGN PATENT DOCUMENTS

| | | |
|---|---|---|
| 1949906 | 11/1966 | Fed. Rep. of Germany . |
| 65003 | 7/1970 | Fed. Rep. of Germany . |
| 7026934 | 7/1970 | Fed. Rep. of Germany . |
| 3501365 | 7/1986 | Fed. Rep. of Germany . |
| 3635345 | 4/1988 | Fed. Rep. of Germany . |
| 1346574 | 3/1970 | United Kingdom . |

*Primary Examiner*—Teresa J. Walberg
*Attorney, Agent, or Firm*—Quarles & Brady

[57] ABSTRACT

In a glass mounting plate, which is provided on the underside with a partly transparent and partly non-transparent mask, is fitted an electric hotplate. An illuminating chamber illuminating by a lamp is connected to its underside. The mask gives rise to a marginal area through which light shines to the outside for indicating the operating state of the hotplate. The mounting plate can also be made from non-transparent material, such as sheet metal. The light then passes through a permeable seal or other transparent mounting components.

19 Claims, 12 Drawing Sheets

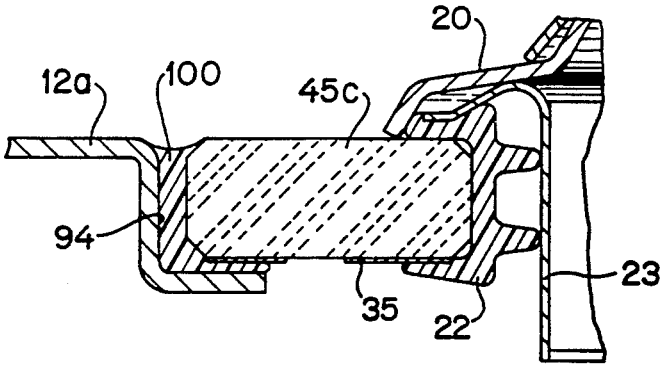
FIG. 17
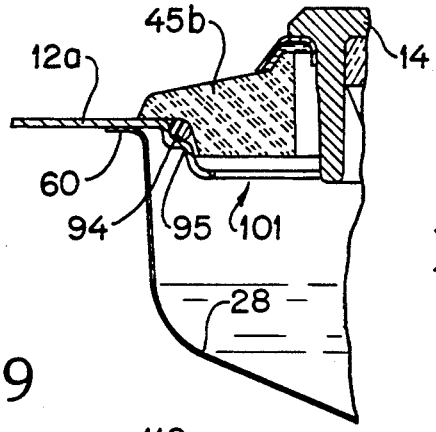
FIG. 18
FIG. 19
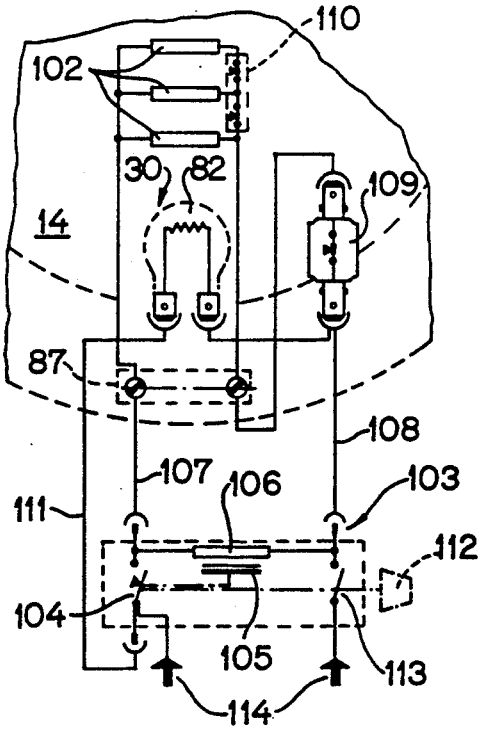
FIG. 20
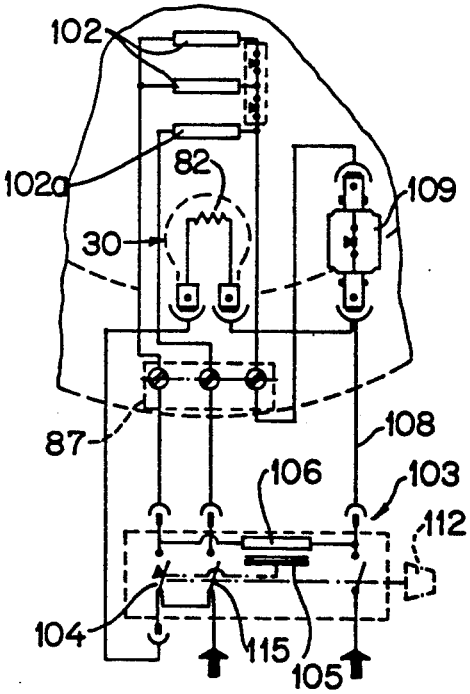

ELECTRIC COOKING MEANS

CROSS REFERENCE TO RELATED APPLICATION

This application is a continuation-in-part of co-pending U.S. patent application Ser. No. 466,513, filed Jan. 17, 1990 now abandoned.

BACKGROUND OF THE INVENTION

The invention relates to an electric cooking means including an indicator for at least one electric hotplate.

DESCRIPTION OF THE PRIOR ART

British patent 1 346 574 (WARREN) discloses a cooker with a glass ceramic cooking surface below which is arranged a heating element. In the case of a contact-heated construction below the glass ceramic plate is provided a metal sieve 6, which has openings in the marginal area of the heating element. The light of a lamp arranged in a tray can pass through these openings and produce a luminous ring shinning round the glass ceramic plate around the cooking surface and which indicates the form and operating state of the cooking surface. Thus, even in the case of cookers with normal temperature heating elements it is possible to obtain an indication directly corresponding to the heating state, which is otherwise only possible with light radiator heating elements, e.g. halogen heat radiators.

German published applications 36 35 345 and 35 01 365, as well as U.S. Pat. Nos. 2,870,316 and 3,067,315 disclose such arrangements, in which the cooking surface made from transparent material is centrally or marginally irradiated.

U.S. Pat. No. 1,699,737 (HICKS) shows an electric hotplate having indicator means included in the cooking surface by a small glas insert member through which the glowing electric heater of the hotplates may be observed.

U.S. Pat. No. 2,346,237 (RUTENBER) shows an electric hotplate with an opaque body mounted in a mounting plate having an electric indicator lamp lighting a small window in the mounting plate.

U.S. Pat. No. 2,492,100 (KITSON) shows an electric hotplate consisting of concentric rings divided by spaces, through which light of an indicator lamp below the hotplate can shine. The lamp is fixed to an laterally open fixing structure.

U.S. Pat. No. 2,659,069 (KINSELLA) shows a cooker with tubular heaters arranged over a tray which may be illuminated from a centrally positioned lamps. The light shines through the spaces between the tubular heater spirals.

U.S. Pat. No. 4,518,850 (GRASSOW) shows a system for warning a hotplate user not to touch the glass ceramic plate if it is hot. The intensity of the illumination of a lamp, the position of which is not described, may vary corresponding to the temperature at the glass ceramic top.

OBJECT OF THE INVENTION

The object of the present invention is to provide such an indicator, which can be used in the case of hotplates having a random structure.

The indicator according to the invention is intended for electric hotplates, which have a non-transparent cooking surface. They can be fitted into mounting plates with recesses for receiving the electric hotplate.

In addition, illuminating means located below the electric hotplate and light passage means are provided, which illuminate a marginal area of the mounting plate or parts thereof surrounding the hotplate.

Such an indicator can consequently also be used in the case of plates made from cast material, e.g. iron, which are e.g. supported by means of a trim ring on the mounting opening.

SUMMARY OF THE INVENTION

If the mounting plate is made from an at least partly transparent material, e.g. hard glass, the light can pass through optionally masked marginal portions of the mounting plate. The said light influencing means can be made from a non-transparent, e.g. black coating of the overall plate with the exception of the transparent portions, which can in turn be coloured, opalized or given some other light influencing construction. The illuminating means can comprise normal electric lamps in heat-resistant holders, e.g. much as for a baking oven illumination system, which are positioned in a shell-shaped illuminating chamber, which surrounds the hotplate from below and is supported on the underside of the mounting plate. The said marginal region can also from the mask. The illuminating chamber can simultaneously replace a clamp on which engages a clamp bolt of the hotplate enabling the downward fixing of the latter. It can also be shaped from the mounting plate material, if it is made from a different material, e.g. sheet metal.

In this case the light passage preferably takes place in the vicinity of the trim ring or an intermediate ring surrounding the latter. Transparent components are then located in the marginal area, in such a way that they have a light entry surface from the underside of the mounting plate and a light exit surface on the top. They can be constructed as transparent sealing materials, which are located between a preferably very wide high-grade steel trim ring and the mounting plate, so that they are at a lower temperature level. The luminous ring can then be seen from the side and also illuminates the mounting plate surface. It is also possible to use glass intermediate rings on which is supported the trim ring, or the trim ring or a bearing intermediate ring can be made from a transparent material. It is also possible to provide marginal cutouts in the mounting plate and which are covered from above or below by transparent materials, e.g. a glass ring.

As a result of a corresponding optical design or treatment, light can be conducted and distributed from the illuminating means (one or more lamps), in such a way that the desired lighting effect, e.g. a uniform or non-uniform illumination of the rim can be obtained. For this purpose it is possible to use light guide means. Thus, for example, the light passage means, e.g. a marginal ring, could simultaneously serve as the light guide and light exit means and the lamp could then be connected thereto at a random point for direct radiation. It is also possible to position a self-illuminating ring with an electric power supply.

The invention makes it possible for the user to directly perceive the heating state. Correspondingly the illuminating means can be switched on and off as a function of the switching state (On-Off) of the power setting, the temperature or the predetermined or preset temperature, or the characteristics thereof can be varied, e.g. light intensity, light color or the delivery of specific light pulses. Thus, it is possible to e.g. indicate the hot state of the plate after its disconnection, which constitutes an additional safety feature.

SHORT DESCRIPTION OF THE DRAWINGS

These and further features of the preferred further developments of the invention can be gathered from the claims, description and drawings. Individual features can be realized in an embodiment of the invention and in other fields either singly or in the form of subcombinations and can represent advantagous, independently protectable constructions for which protection is hereby claimed. The invention is described in greater detail hereinafter relative to the drawings, wherein show:

FIG. 1: a plan view of part of a cooker.

FIG. 2: a view of the cooker from below.

FIG. 3: a section along line III in FIG. 2.

FIG. 4: a detail section along line IV in FIG. 2.

FIG. 5: a mounting variant.

FIGS. 6 to 10: variants of light passage means in the marginal areas and in each case in detail section.

FIG. 11: a vertical partial section of a cooker.

FIG. 12: a detail of FIG. 11

FIG. 13 A sectional view like FIG. 11 through an embodiment with integral illuminating chamber.

FIG. 14 A partial section like FIG. 11 of a hotplate of larger diameter.

FIG. 15 A section through a lamp socket

FIG. 16 A plan view of a part at a cooker like FIG. 11 and 15.

FIGS. 17 and 18 Embodiments comprising a glass ring.

FIGS. 19 and 20 Circutry for hotplate an illuminating means.

FIG. 21 A partial section through an embodiment with a illuminating chamber insert.

FIG. 22 A front view of the insert

FIGS. 23 and 24 Plan view and section of an embodiment of a double hotplate system.

DETAILED DESCRIPTION OF PREFERRED EMBODIMENTS

Figure 1:
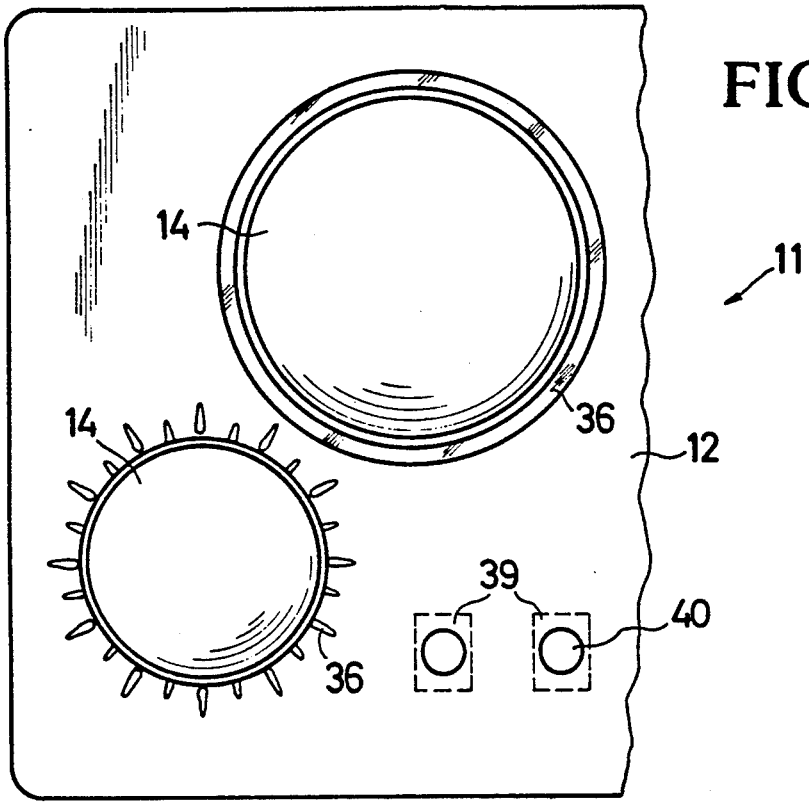
Figure 2:
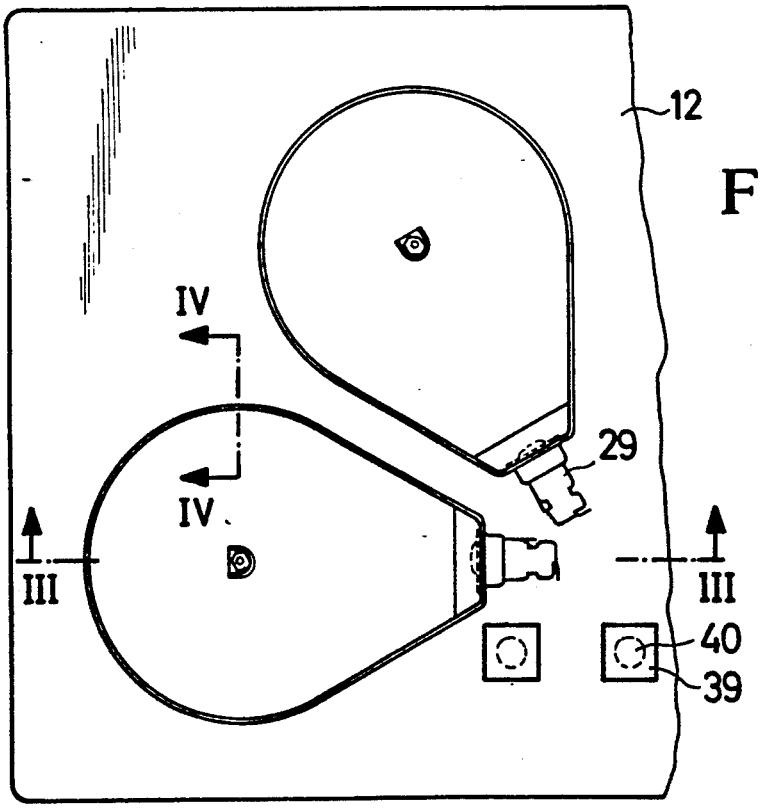
Figure 3:
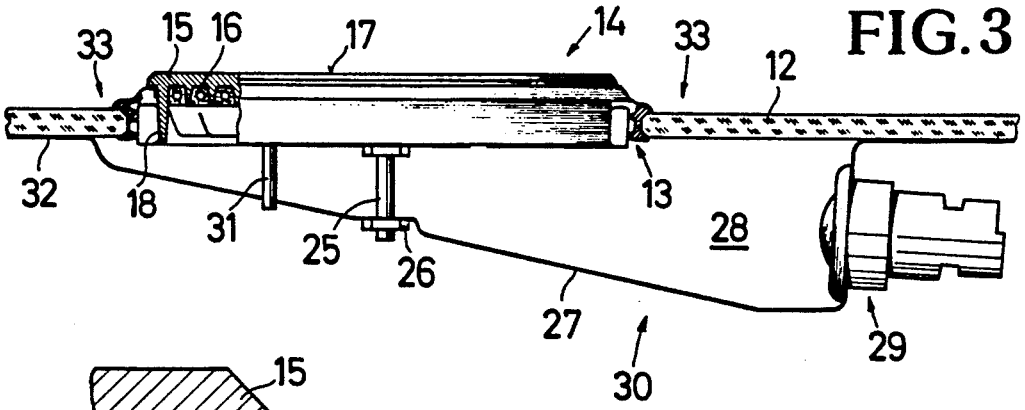
Figure 4:
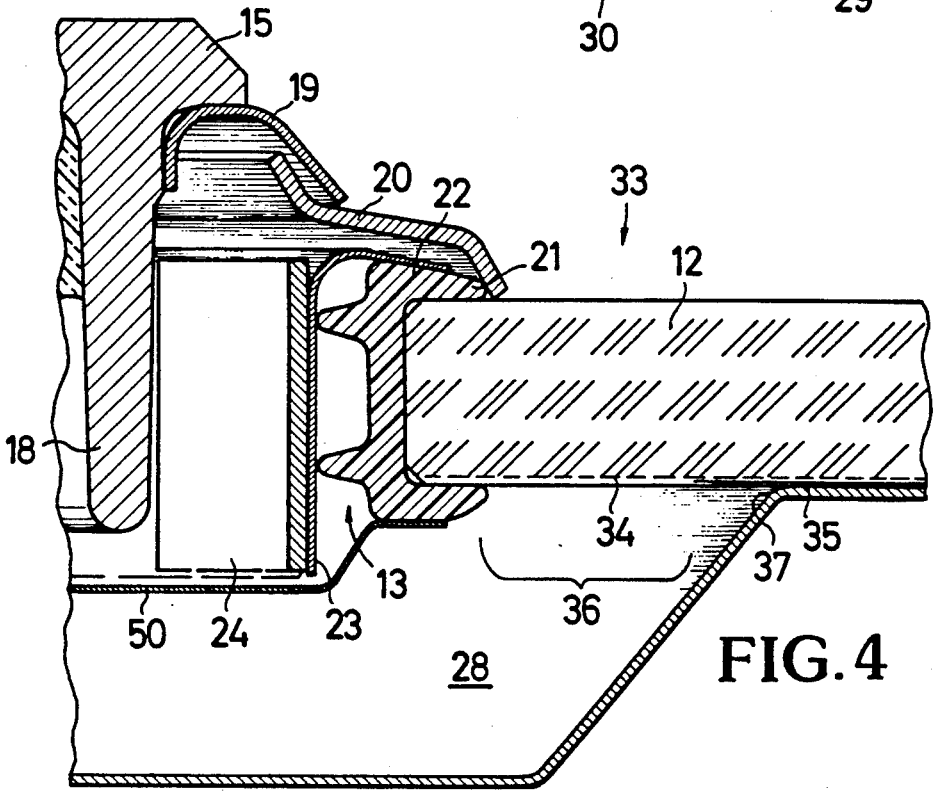

FIGS. 1 to 3 show a cooker 11 with a hard glass mounting plate 12, which has recesses 13 in the form of circular openings and in which can be fitted electric hotplates 14. The electric hotplates comprise a hotplate body 15 made from cast iron with an electric heating means 16 embedded in grooves on the underside, an upper, planar cooking surface 17 and a downwardly directed outer rim 18, onto whose outside is pressed a trim ring 19 made from thin, stainless sheet steel (FIG. 4). It is directed so as to slope outwards and downwards and is supported on an intermediate ring with an S-shaped cross-section, whose outer edge 21 rests on the mounting plate 12 in the marginal area of opening 13.

Fitting takes place in the conventional way with an elastic sealing ring 22, which surrounds the inner edge of opening 13 and is held by a L-shaped sheet metal ring 23, which has U-shaped, inwardly projecting support parts 24 for centering the hotplate.

FIG. 4 shows a lower cover 50 for the hotplate mounting unit which, pressed by the center stud 25, bears on the lower flange of seal 22. It insulates the hotplate towards the bottom and forms an upper reflector part for illuminating chamber 28.

The hotplate is fixed downwards by a center stud 25, whose nut 26 engages on the shell-shaped casing 27 of an illuminating chamber 28, which forms an illuminating means 30 together with a lamp 29. Casing 27 also prevents the rotation of hotplate 14 by a rotation preventing bolt 31 engaging in a recess of casing 27 (FIG. 3).

The casing is circular with a funnel-shaped attachment, at whose end is arranged the lamp 29 with a lighting axis directed towards the center of the hotplate (FIG. 2). The lamp axis points upwards under a slight angle (FIG. 3) and the casing bottom rises in an upwardly sloping manner from the lamp. This design can be modified in numerous different ways from both the mounting and optical standpoints.

Casing 27 is part of a structure for supporting the hard glass plate 12, i.e. a metal sheet arranged under said plate and from which the illuminating chambers 28 are shaped. When the illuminating chambers are arranged individually, they can also be individually manufactured, so that they then bear with flanges 32 on the underside of mounting plate 12 and namely with a radial spacing such, as shown in FIGS. 3 and 4, a marginal area 33 of mounting plate 12 around hotplate 14 is covered by the illuminating chamber 28.

The hard glass mounting plate 12 is provided with a corresponding stoved, heat-resistant coating with light influencing means 34, 35 (FIG. 4), which in turn on the one hand form a decoration (possibly only black) and on the other constitute a mask, which in the marginal area 33 produces a pattern, which is located at desired points or preferably passes round the entire hotplate and can have a varying configuration, e.g. can be in the form of a smooth ring or an irregular radial system in accordance with FIG. 1.

FIG. 4 shows two coatings 34, 35 of the light influencing means, which on the one hand symbolize a mask 35 and on the other a coloring or opalizing 34 preventing viewing within the illuminating chamber 28. It is also possible to color the hard glass plate. Masking 35 can also take place through the border 37 of the illuminating chambers.

Lamp 29 can be a standard electric light with a heat-resistant holder (oven light), which contains a small halogen lamp. It can be replaced from the underside of the cooker and is electrically connected to the hotplate switches or regulators 39, which are operable by knobs 40 and switch on the lamp in the desired operating state; in the simplest state On when the hotplate is connected and Off again when it is disconnected. For this purpose the switches and regulators contain signal contact paths. A connection to a not shown temperature sensor on the hotplate or located around the same is possible for temperature indication through the illuminating device.

Figure 5:
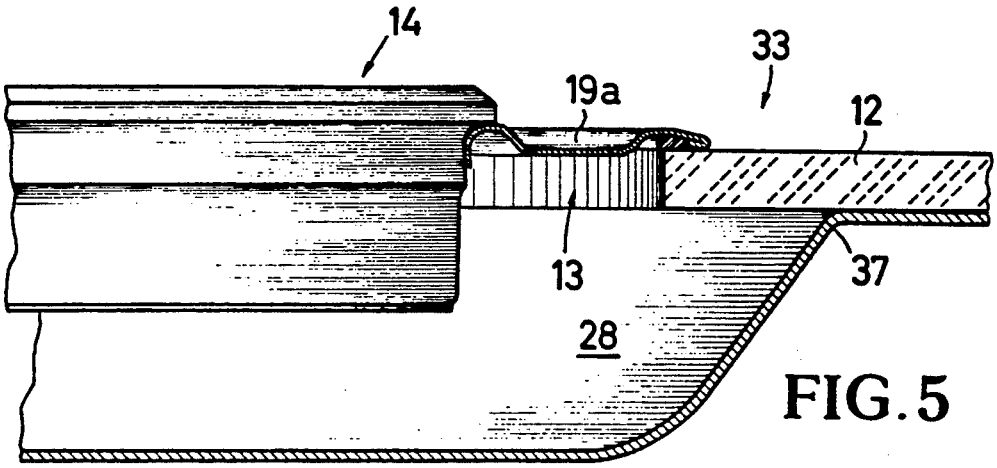
Figure 6:
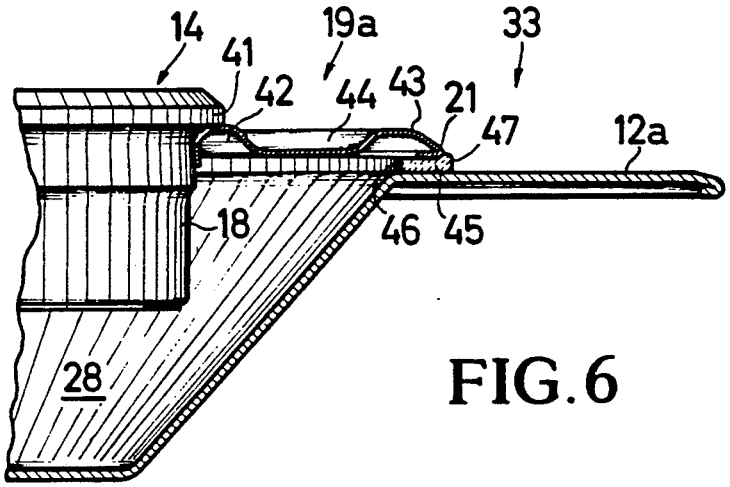

FIG. 5 shows a construction with a hard glass mounting plate 12, in which the hotplate 14 is fitted by means of a very wide sheet metal trim ring **19*a* in the enlarged recess 13 of mounting plate 12. The ring is supported by means of a seal on the glass plate and, as can be seen in FIGS. 1 to 4, the trim ring 19*a* defines the inner area of the illuminated marginal area 33 and therefore the pattern 36, whilst in the present case the outer edge 37** also determines the outer edge of the pattern. Thus, there is no need for a separate masking of the hard glass plate, provided that it is somewhat transparent, but is preferably not translucent.

FIGS. 6 to 9 show different sealing profiles in conjunction with a hotplate 14 of the previously described type and a trim ring similar to FIG. 5. The flat sheet metal ring with a width between 1/20 and 1/5 of the hotplate diameter is pressed onto the hotplate rim 18, is supported on a flange 41 and has a cross-sectional shape with an outer and inner bead 42, 43 between which is located a central depression 44. The flanged outer edge 21 is supported on a seal 45, which is made from an elastic, heat-resistant, transparent material and consequently forms a light passage means between the illuminating chamber 28 of the above-described type and the marginal area of mounting plate 12*a* surrounding the hotplate. The transparent seal 45 is circular and is internally provided with a light entry surface 28 directed towards the illuminating chamber and is externally provided with a substantially vertical or sloping light exit surface 47.

In FIGS. 6 to 10 the mounting plate 12*a* is made from a non-transparent material, e.g. enamelled sheet metal. The illuminated marginal area in this case comprises the light exit surface 47 of seal 45 and part of the mounting plate surface illuminated by it from above. The illuminating chamber 28 is shaped directly from the material of the mounting plate 12*a* and consequently simultaneously stiffens the mounting plate and the necessary clamping and centring means for the hotplate 14.

The wide, flat, stainless steel trim ring 19*a*, which optionally has a colored surface coating ensures that in the vicinity of the seal 45 the temperature is at a level which can be withstood without damage by transparent sealing materials (such as silicone rubber).

As an alternative it would be conceivable to zonally perforate the trim ring 19*a* in the vicinity of depression 44 and to line the depression with a transparent material, e.g. a stoved fritted glass, so that the illuminated marginal area would be located in the vicinity of the trim ring.

Figure 7:
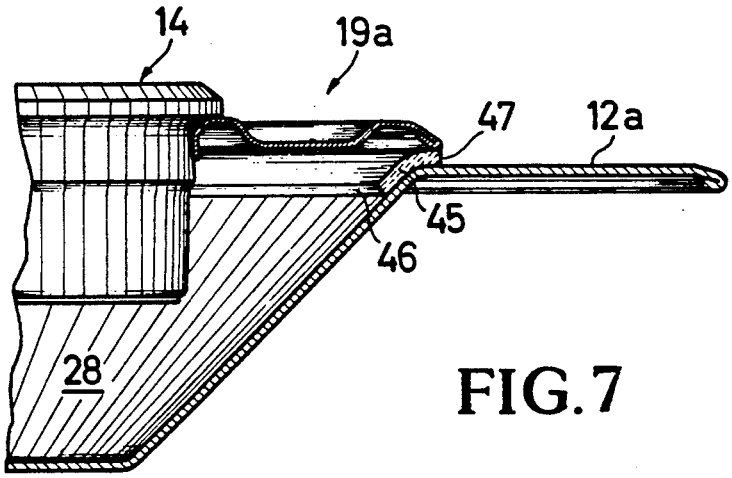
Figure 8:
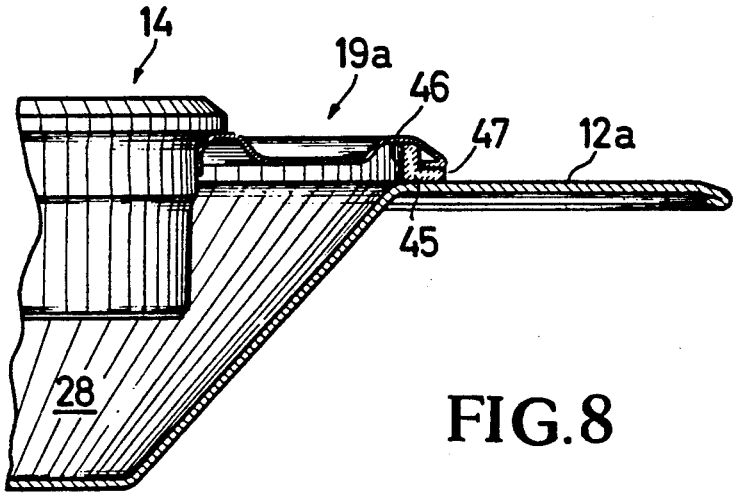
Figure 9:
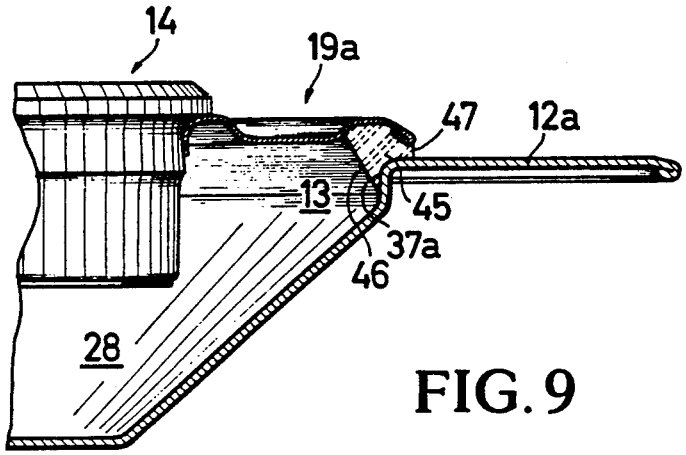

With an otherwise identical construction to FIG. 6, FIGS. 7 to 9 show other forms of transparent seals 45, which in FIG. 7 have a light entry surface 47 favorable from the irradiation standpoint and through a L-shaped cross-section in FIG. 8 permit a good centering on the trim ring 19*a*. In FIG. 9 the seal 45 also has a very large, advantageously downwardly sloping light entry surface 46 and fills the outer bead 43 of the trim ring 19*a* and surrounds the edge 37*a* of the recess 13, so that there is a good centering of the seal and hotplate. In FIGS. 6 to 9 the recess 3 is formed by a depression in the mounting plate 12*a* also forming the illuminating chamber 28.

Figure 10:
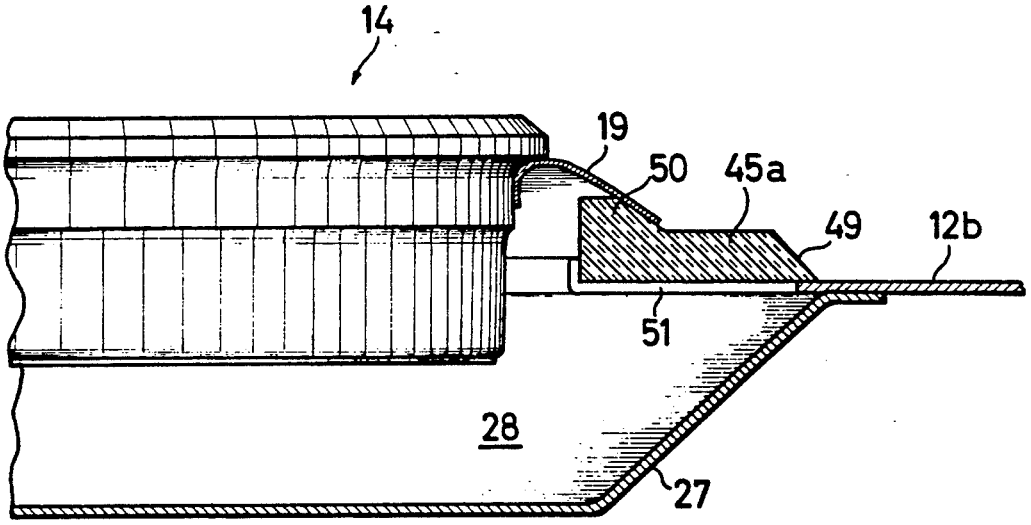

FIG. 10 shows the hotplate 14 with a trim ring 19, which rests on a glass ring 45*a*, which has a circular disk-like profile with a sloping outer edge 49 and an upwardly directed inner bead 50, which is adapted to the cooperating bevel of trim ring 19.

Ring 45*a* is located on the mounting plate 12*b*, which is also made from sheet metal and extends up to the interior of the ring, but has openings 51 covered by ring 45*a* and which correspond to the desired illumination pattern. Thus, in this case the light can pass directly from the outside from the illuminating chamber 28 and via the openings 51 and ring 45*a* and said ring consequently forms the illuminated marginal area and therefore the indicator. Advantageously the light passage means are formed by partly transparent mounting elements. The illuminating chamber is formed by a separate casing 27 in the form of a shell supported on the underside of mounting plate 12*b*.

For random hotplate types the invention creates an appropriate indication aiding operating comfort and safety. It is also suitable for differentiating different hotplate types from one another, e.g. by an indicating circular ring for normal hotplates and a radial rim, modified light color or pulsating light for increased power hotplates. Thus, the invention avoids errors in the association between the knob and the hotplate. In the following drawing identical or functionally identical parts are given the same reference numerals and reference should be made to the preceding description with regards to the features thereof.

Figure 11:
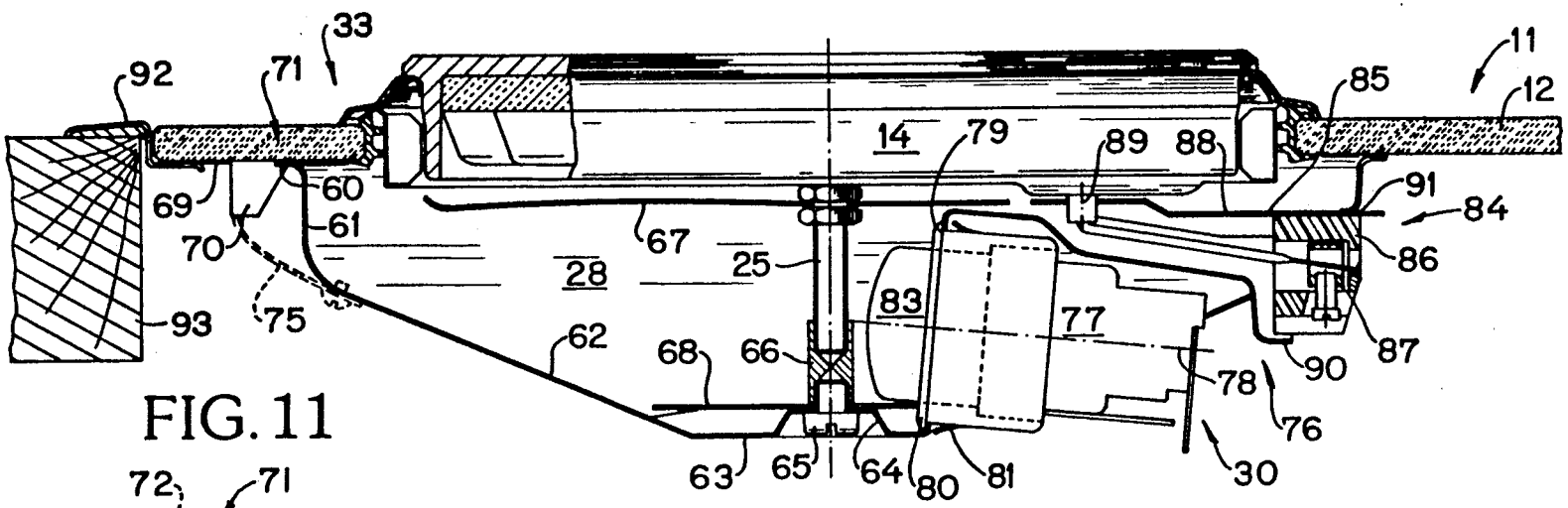

FIG. 11 relates to a cooker 11 with a hard glass mounting plate 12, as in FIGS. 3 to 5. The illuminating chamber 28 has a somewhat tray or dish shape with an upper and outer flange 60, a roughly cylindrical casing part 61 connected thereto and a larger, sloping intermediate wall portion 62, which passes into a substantially horizontal, smaller base portion 63 in whose depression 64 engages a fixing screw 65. It is screwed into an intermediate part 66 with a two-way screw thread, which is screwed onto a center stud 25 of the hotplate. Reflector plates 67, 68 are arranged substantially horizontally in the upper and lower region of the illuminating chamber 28 and cover the bottom and underside of the hotplate. They ensure a planned reflecting back of the light into the illuminating chamber and also provide an additional radiant heat protection for the illuminating means. They are fitted to the center stud 25 by nuts or the fixing screw 65.

Figure 12:
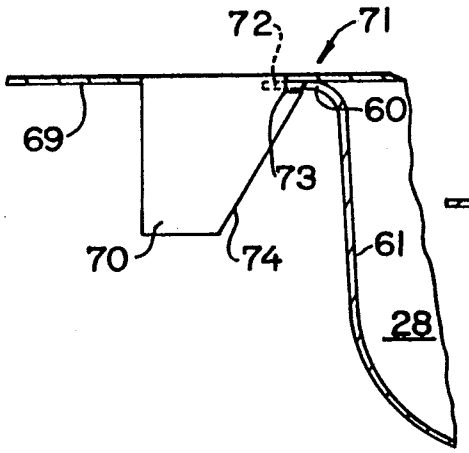

The illuminating chamber 28 engages by its outer flange on a support plate 69, which is positioned below and supports the glass mounting plate 12. Out of the said plate is punched or stamped a fixing lug 70 and is bent downwards so as to form part of a torsion preventing means. For this purpose the flange 60 is circumferentially provided with e.g. three slits 72 (FIG. 12) which, in the vicinity of the recesses 73 of the fixing lug 70 engage in the same. As the side 74 of the fixing lug 70 directed towards the hotplate is bevelled, it is possible to press the illuminating chamber 28 from below between the lugs 70, which leads to a certain deformation thereof and finally engages with its slits 72 in the recesses 73. It is therefore prevented from falling out in the downwards direction. The final fixing takes place by tightening the fixing screw 65. Fitting is facilitated by the catch protection. FIG. 11 shows in broken line form that for the case that it is necessary to have a separate earthing or grounding connection between the support plate and the illuminating chamber, this can be created by an additional extended tongue 75 on the fixing lug 70, which is screwed to the illuminating chamber.

In the illuminating chamber 28 and particularly in the sloping intermediate wall portion 62 is provided an upwardly shaped mounting portion 76, which interrupts the tray-shaped configuration of said chamber 28 and is extended upwards almost to the underside of the electric hotplate 14. It is so cambered or made semicircular that it is possible to arrange therein a lamp or bulb socket 77 with a substantially horizontal axis 78, which is inclined slightly upwards towards the hotplate center. For this purpose the socket portion has an opening 79 directed towards the hotplate center and on this engages a socket flange 80 and is secured by securing lugs 81. By turning the socket they can be brought into the vicinity of cutouts and consequently the socket can be removed. In said socket is inserted a bulb 82 (FIG. 15), which is optionally covered by a glass cover 83 (FIG. 11), which can also be colored. It can be seen that the socket is positioned laterally and substantially horizontally, but in the vicinity of the hotplate is located below the latter, so that the illuminating chamber need be no larger than a conventional mounting tray for the hotplate. Its centrally directed beam or emission produces an illumination of the marginal area 33 of the mounting plate 12 constructed according to FIG. 4.

The socket is positioned in such a way that the hotplate connection 84 passes over the socket area 76 and comprises a connecting plate 85 fixed to the underside of the hotplate and projects laterally over the hotplate circumference and carries at this point an insulator 86, in which are provided terminals 87 for the hotplate leads. From the latter connecting wires 88 lead into the hotplate and are passed into the interior thereof through an insulating passage 89. This arrangement not only simplifies the connection of the illuminating means to the electric leads by having the shortest possible paths, but in particular ensures that an impeding of the light passage on the hotplate circumference only takes place in the socket area 76, where in any case there would be a certain covering by the lateral connection 84. As a result of the slightly inclined arrangement of the socket adequate space is provided for guiding the connection. Hold-down portions 90 of the illuminating chamber wall in the socket area 76 engage over the insulator 86 and prevent any downward bending of the latter, whilst an upper portion of an opening 91 provided for the hotplate connection in the illuminating chamber wall ensures that the connecting plate 85 cannot be bent excessively upwards. Thus, the uninsulated connecting wires 88 are passed with an adequate insulation spacing between the sheet metal parts surrounding them. It is also possible to interpose an insulating plate between them and the socket area 76. The cooker 11 with its mounting plate 12 is fitted by means of a mounting frame 92 in a work surface, such as e.g. a kitchen unit.

Figure 13:
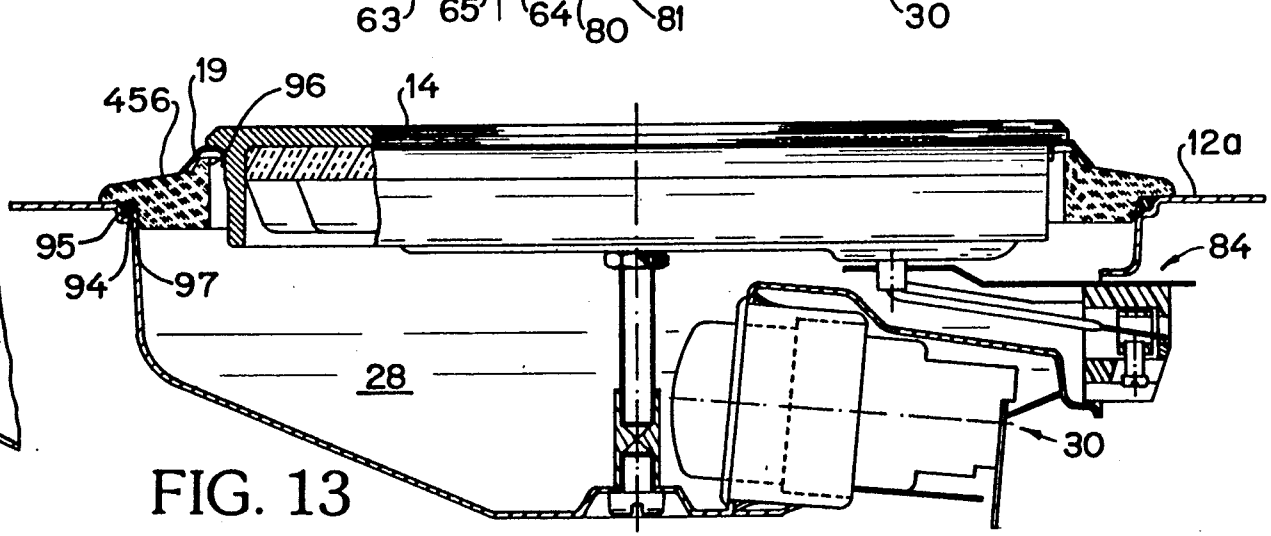

The construction according to FIG. 13 differs from that of FIG. 11 in that a sheet metal mounting plate **12*a* is provided, from whose material is downwardly formed the illuminating chamber 28. In the marginal area of the illuminating chamber 28 is formed a marginal groove 94 in which is located a sealing ring 95. It seals a ring 45*b* in the form of a hard glass molding and which is interposed between the mounting plate 12*a* and the mounting ring 19 of the hotplate 14**.

Its cross-sectional shape is bounded at the top by a central, slightly inclined surface, terminating more steeply externally and whereby on the inside is provided a raised spillage rim 96. It passes in the marginal area of the illuminating chamber 28 through an angular recess 97 on the lower circumferential portion. As a result of its transparent construction irradiated on the substantially planar underside of the illuminating chamber 28, it offers ideal radiation conditions.

Figure 14:
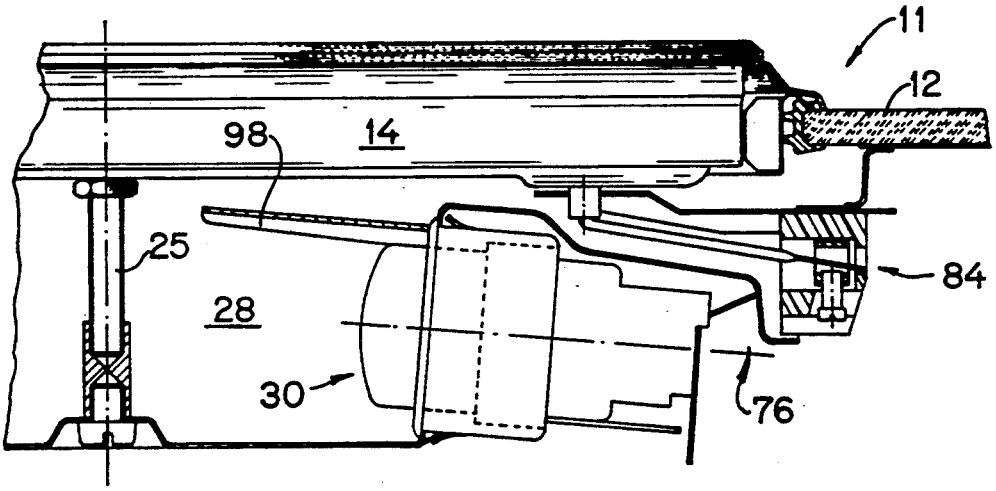

FIG. 14 differs from FIG. 11 as a result of the fact that use is made of a larger circumference hotplate 14. It can be seen that in the correspondingly larger illuminating chamber 28 the illuminating means and therefore also the receiving socket area 76 is moved further outwards, so that there is a larger spacing between the center stud 25 and the illuminating means 30. It is possible in addition to or instead of the reflector 67 to fit a lamp or bulb shield 98 to the socket 77, which instead of ensuring good reflection conditions shields or protects the bulb against heat radiation from the hotplate.

Figure 15:
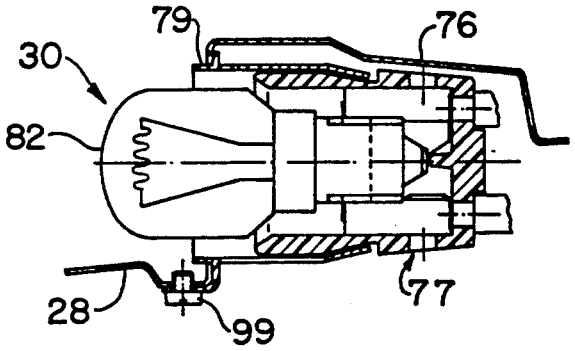

FIG. 15 shows the bulb or lamp socket 77 without the glass cover. In this construction it is fixed by a screw 99, accessible from below, to the wall of the illuminating chamber 98, so that the socket can be outwardly removed for replacing the bulb.

Figure 16:
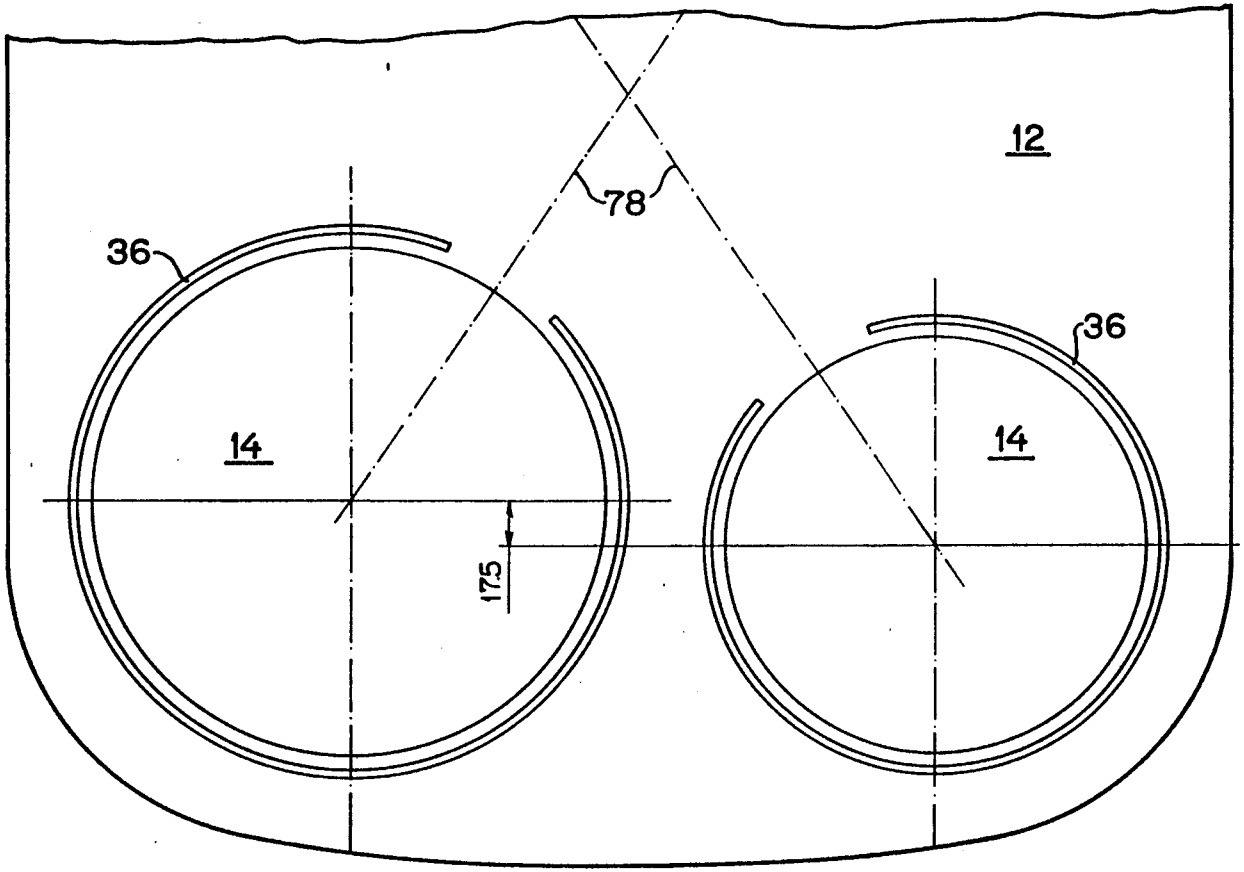

FIG. 16 shows in plan view two hotplates of different size (e.g. to the right according to FIG. 11 and to the left according to FIG. 14). The connecting and socket areas can be directed towards the center, so that the connection axes 78 intersect (also those of the not shown two further hotplates of the cooker 11). The corresponding pattern 36, i.e. the transparent area of the otherwise masked mounting plate 12 is in this case circular and is only interrupted on either side of the axis 78, i.e. in the socket and connection area. It would also be possible to incorporate this interruption into a pattern, which would e.g. comprise individual ring portions.

FIG. 17 shows a construction with a sheet metal mounting plate **12*a*, which forms a marginal groove 94 through a cross-sectionally angularly downwardly directed part. Into the said groove is inserted by means of an adhesive sealant 100 a ring 45*c*, which comprises a flat annular disk, i.e. a glass ring with planar upper and lower ring faces and substantially cylindrical inner and outer boundaries. It can be more easily manufactured than a profile ring and forms an insert in the mounting plate 12*a*, which is substantially located in its plane. On the inside it has an engaged-on elastic ring 22, as described relative to FIG. 4 and also engages on a centering and shielding sheet metal ring 23. The fitting of the hotplate to the ring 45*c* can take place in the same way as described for the glass mounting plate 12 in FIG. 4. If desired, the underside of the ring 45*c* can be provided with a masking 35. The illuminating chamber not shown in FIG. 17 can be fitted in one piece or separately from the plate 12*a* (as in FIG. 18**).

FIG. 18 shows a construction with a sheet metal mounting plate **12*a* and an intermediate glass ring 45*b*, as described in FIG. 13. The marginal area surrounding the mounting opening 101 has a double angular configuration, which surrounds a marginal groove 94 with sealing ring 95. The flange 60 of the illuminating chamber 28 engages on the underside of the mounting plate 12*a*** outside said stiffening marginal formation.

FIG. 19 shows a circuit of the three heating resistors 102 of the hotplate 14 and the illuminating means 30. It is a timing, power-controlled hotplate with a corresponding power control device 103, whose timing switching contact 104 is operated by a bimetal 105, which is heated by a control heating means 106. The electric hotplate is supplied with power via two leads 107, 108, the lead 107 passing directly to the corresponding terminal 87, whilst the lead 108 passes to an additional temperature switch 109, which is mounted on the underside of the illuminating chamber, i.e. outside the illuminating area directly alongside the socket area 76 or the connecting area 84. As a result of this external arrangement the additional temperature switch determines the ambient temperature of the hotplate/illuminating unit and ensures that in the outer area of the hotplate the temperature is kept at a value which is not prejudicial for the environment, e.g. a wood work surface 93 (FIG. 11). In addition internal temperature switches 110 can be provided, which individually or combined switch off the parallel connected heating resistors 102.

From the temperature switch 109, which eminently determines the external temperature especially in the critical area with a certain additional heating through the connection and the illuminating means, the hotplate connection passes to the other pole of the terminals 87, whilst one pole of the bulb 82 is directly connected to the connection 108. An independent return lead 111 passes from the other bulb pole to the corresponding mains pole. Thus, the illuminating means 30 is connected in if by rotating the knob 112 of the power control device 103 the manually operable contact 113 applies the lead 108 to the domestic mains 114. Thus, independently of the timing state of the power control device and the temperature limiter switching states the illuminating means is always connected in if the hotplate is switched on and consequently functions as an operating state indicator. When connecting several hotplates a common return lead 111 can be provided for all the illuminating means, so that only one additional line per cooker is required. The construction according to FIG. 20 differs from that according to FIG. 19 by an additional contact 115 in the power control device 103 leading to the connecting in of the heating resistor 102*a* in an upper power range (for 100% relative on-time of the contact 104), whilst the timing switching contact 104 only operates two heating resistors 102. Here again the bulb functions as an operating state indicator through corresponding circuitry. By corresponding wiring, e.g. the connecting in of a diode, it could also react to the increased additional power through a corresponding modification to its brightness.

Figure 21:
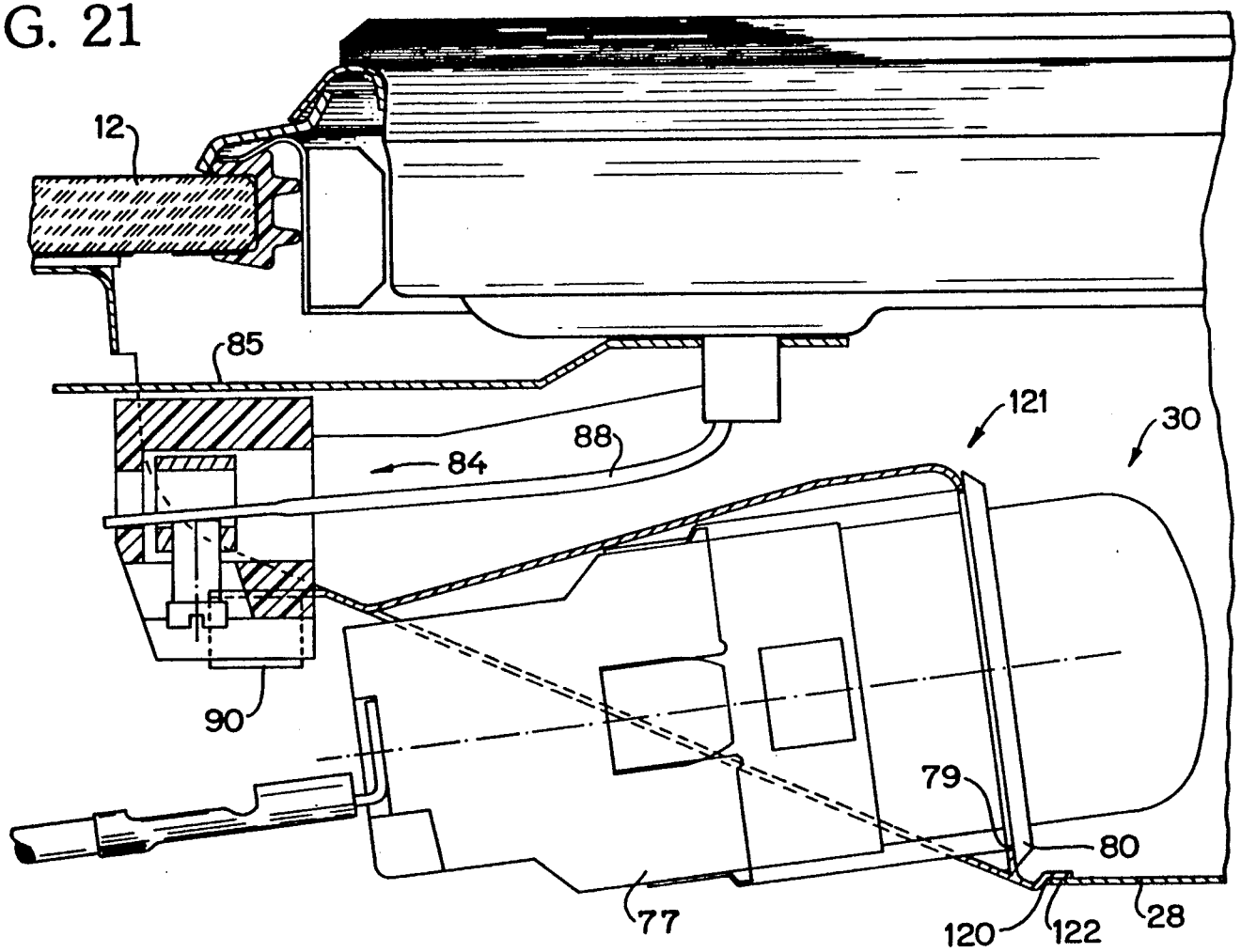
Figure 22:
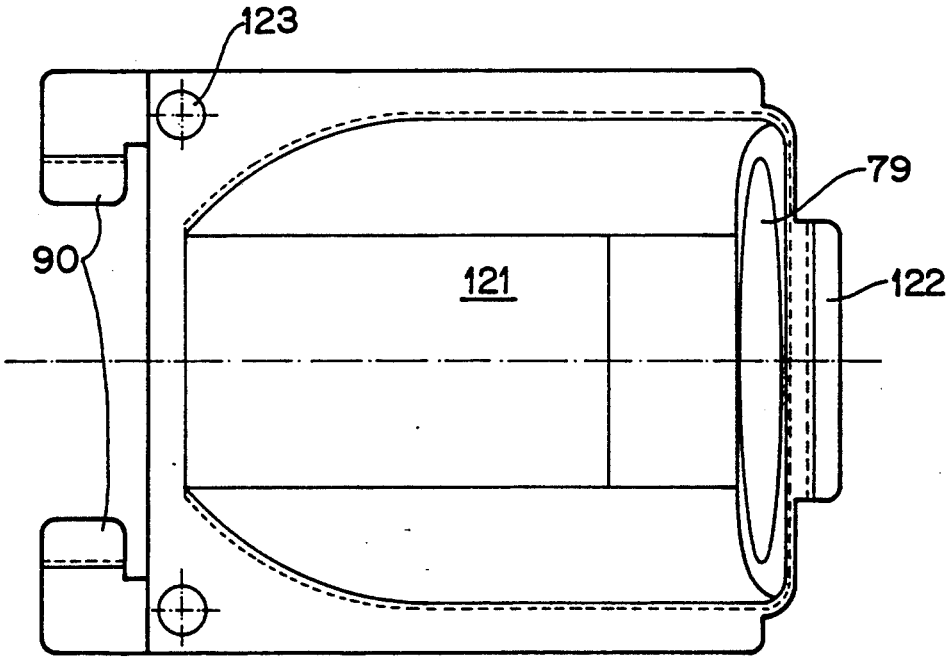

FIG. 21 shows a construction corresponding to FIG. 11, where the circuit area 76 is not formed on the wall of the illuminating chamber 28, but is instead constructed as a separate illuminating insert 121, which is inserted in an opening 120 formed in the illuminating chamber 28. Thus, the illuminating insert 121 shown in FIG. 22 has on its side directed towards the center of the hotplate a holding nose 122 with which it engages behind the edge of the opening 120. Two screws engage in holes 123 and fix the insert. Hold-down portions 90 are provided in order to position the insulator 86. This construction permits an easy bulb change by removing the illuminating insert and also facilitates the construction of the illuminating chamber as a sheet metal stamping.

Figure 23:
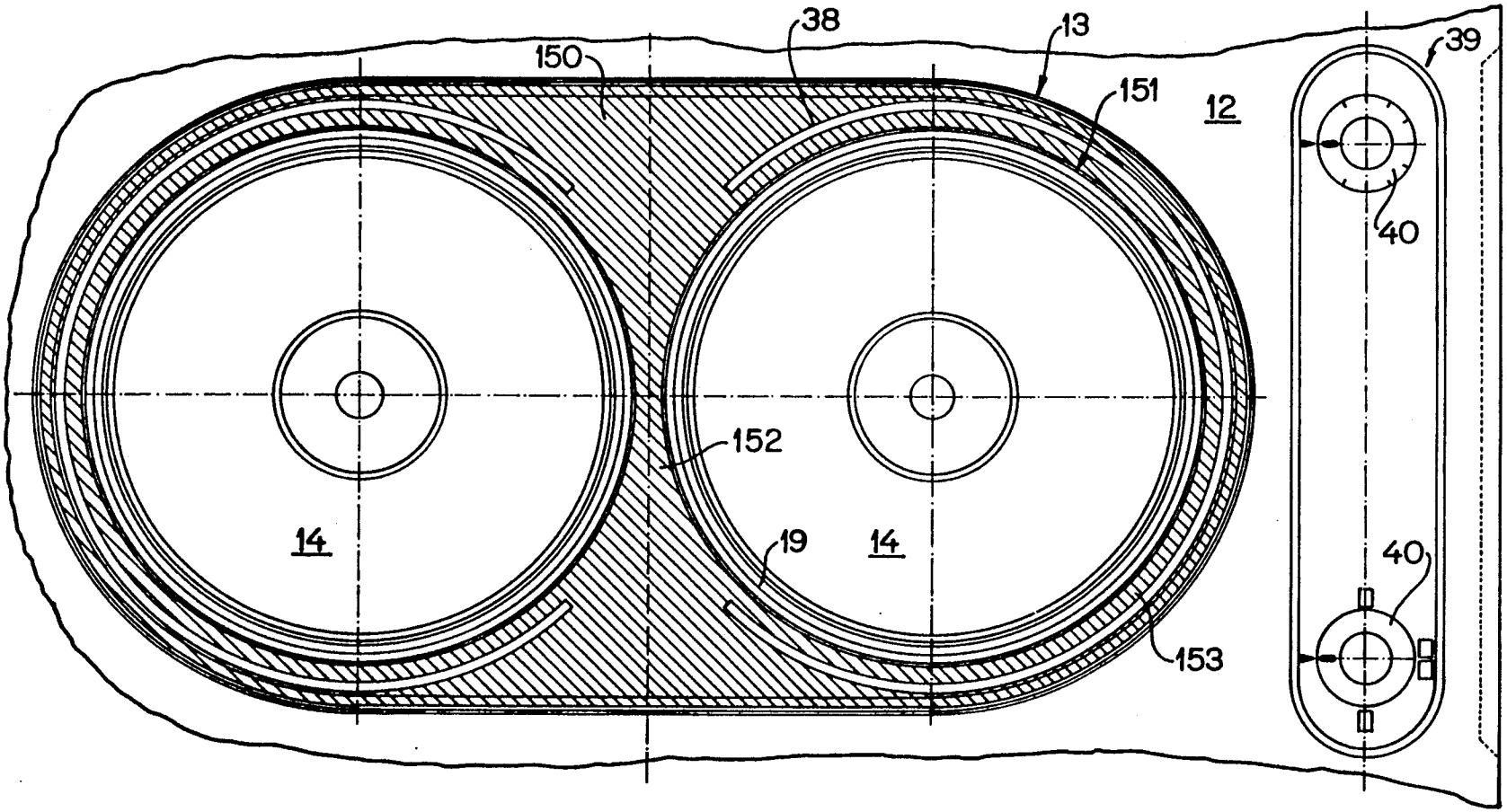
Figure 24:
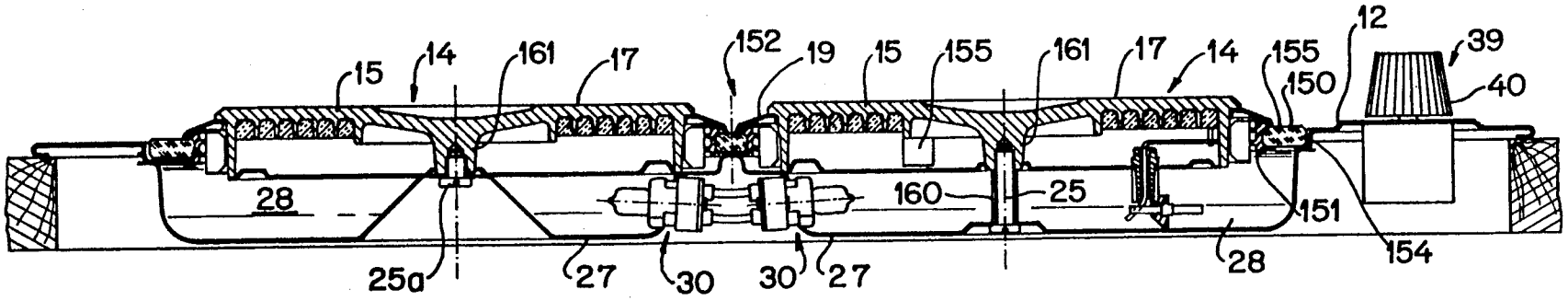

FIGS. 23 and 24 show two electric hotplates 14, which are fitted in a mounting plate 12 made from a random material, e.g. stainless sheet sheeting. The mounting opening 13 in the mounting plate 12 is oval and preferably comprises two identical semicircular arcs, which are connected by straight portions (slot shape). On the same is placed an adaptor 150, which has a meniscus shape. The outer contour corresponds to the mounting opening 30 and in each of the lateral arcuate portions is provided a circular cutout 151 for in each case one hotplate.

The two hotplates 14 are supported by means of external, relatively flat and wide mounting rings 19 on the adaptor 150. The hotplates 14 are positioned in closely adjacent manner. As they are positioned on a highly planar plane free from thermal deformations and other distortions, namely the upper adaptor surface, which is made from hard glass, i.e. a particularly heat-resistant and thermal stress-free material, the cooking surfaces 17 thereof are exactly located in a common plane, so that the double hotplate unit formed by the two hotplates 14 and the adaptor 115 can be used for heating elongated cooking vessels, such as roasting pans, as well as for warming serving plates, etc.

In the prior art it was almost impossible to so precisely align the hotplates with their cooking surfaces as to bring about a uniform contact of both plates with the cooking vessel. Therefore certain points always tended to have an increased heat transfer and consequently encourage the burning of food at these points. This problems is eliminated by making the adaptor from heat-resistant, distortion-free material.

Said adaptor also makes is possible to provide light passage means 38 as a window in a mask of the underside of the adaptor 50. The illuminating means are formed by a strip passing by approximately a three quarter circle around each hotplate and which is interrupted in the central area 152, where the two hotplates 14 are closest together. The outer rim 153 passing round half of the hotplate is as narrow as is possible for manufacturing reasons, but offers sufficient space for the light passage means.

The adaptor 150 is so inserted in a depression 154 of the mounting plate 12 that the adaptor top surface 155 is roughly in the plane of plate 12. Fitting can e.g. involve the interposing of e.g. pasty sealants.

The associated control and regulating devices 39 are somewhat raised in the surface of the mounting plate 12. The two knobs can be so mechanically or electrically interconnected that the hotplates can either be operated separately or jointly and would then be kept at the same temperature and/or power level.

FIG. 24 shows that halogen lamps are used as the illuminating means 30 and allow a shallow construction of the illuminating chambers 28 and lead to a high light intensity. In the case of electronic regulating or control means the low voltage required for the same is in any case present in the system. The represented arrangement, in which the two lamps are positioned directly adjacent to one another below the central portion 152, has the advantage of a uniform illumination of the light passage means 18 and a common central connection.

As a function of which of the hotplates is connected in, the illuminating means can be operated independently of one another, so that the user can see whether one or both hotplates is in operation.

It is also possible to provide a hot indicator for the hotplates and this can e.g. contain a temperature switch 156, which is thermally coupled to the hotplate body 15 and optionally for more rapid response can contain an additional heating means. This switch indicates if the hotplate has assumed a temperature making contact hazardous (70° to 110° C.) and this applies both when heating and when cooling. It could be so coupled with the illuminating means 30 for all the represented embodiments that with the hotplate switched off a corresponding hot indicator could enable the illuminating means to be operated with a lower light intensity, e.g. by connecting in a diode or the like. Thus, the indicator also becomes a warning device.

FIG. 24 e.g. shows two different constructions of the illuminating chamber 28 and its casing 27. Whereas in the right-hand hotplate the casing has a substantially flat bottom and is fixed to a center lug 161 of the hotplate by means of a long bolt 25 and accompanied by the interposing of a spacing sleeve 160, in the left-hand construction the central area of the casing 27 is conically upwardly shaped and is fitted by a short screw 25*a* directly to the center lug 161 of the hotplate body 15.

We claim:

1. An electric cooking means comprising:

at least one electric hotplate, having a non-transparent cooking surface;

a mounting plate having at least one recess for receiving the hotplate;

at least one illuminating means being positioned below the mounting plate and the hotplate and having an illuminating chamber and light passage means for illuminating at least parts of a marginal area of the mounting plate surrounding the hotplate, the electric hotplate having a hotplate body made from cast metal and being surrounded by a mounting ring, which is supported on the marginal area of the recess of the mounting plate;

the light passage means embracing transparent portions of the mounting plate, the mounting plate being made from vitreous material and containing light influencing means, which leaves transparent portions in the form of a pattern surrounding the recess.

2. An electric cooking means comprising:

at least one electric hotplate, having a non-transparent cooking surface;

a mounting plate having at least one recess for receiving the hotplate in a substantially tight manner;

at least one illuminating means being positioned below the mounting plate and having an illuminating chamber and light passage means for illuminating at least parts of a marginal area of the mounting plate surrounding the hotplate, the illuminating chamber being substantially closed and having a flat tray shape with light reflecting inner walls;

the illuminating means containing at least one electric lamp, which illuminates the tray-shaped illuminating chamber and which has an area surrounding with a substantially uniform spacing the hotplate, the illuminating chamber having a socket area in which the socket for the lamp is arranged, the socket for the lamp being provided in an area located laterally below the hotplate and substantially at the same horizontal level as the chamber and the lamp having a central axis being directed substantially horizontally towards the hotplate center, the socket being positioned in a socket portion penetrating the tray shape of the illuminating chamber.

3. An electric cooking means according to claim 2, wherein the illuminating chamber engages with its edge on the underside of the mounting plate.

4. An electric cooking means according to claim 2, wherein the illuminating chamber is shaped from the material of mounting plate means, including the mounting plate or a substructure for the mounting plate.

5. An electric cooking means according to claim 2, wherein the socket area is located below a connecting area of the hotplate, in which connecting area the electric leads of the hotplate are guided and pass out of the illuminating chamber.

6. An electric cooking means according to claim 2, wherein an illuminating insert is removably inserted in the socket area, the insert carrying a lamp socket, and being inserted in an opening in the wall of the illuminating chamber.

7. An electric cooking means according to claim 2, wherein the illuminating means have light distribution properties, which lead to a uniform light distribution over the circumference of the electric hotplate.

8. An electric cooking means according to claim 2, wherein the illuminating means can undergo variations with respect to their characteristics, such as light intensity and colour, light pulse duration and nature, as a function of the operating values of the electric hotplate, such as switching states, power setting, temperature, predetermined temperature.

9. An electric cooking means according to claim 8 wherein a temperature dependent switching means is provided responding to the hot state of the hotplate and the characteristics are variable as a function thereof.

10. An electric cooking means according to claim 2, wherein substantially horizontal reflector disks are located in the illuminating chamber.

11. An electric cooking means comprising:

at least one electric hotplate, having an non-transparent cooking surface;

a mounting plate having at least one recess for receiving the hotplate;

at least one illuminating means being positioned below the mounting plate and hotplate and having an illuminating chamber and light passage means for illuminating at least parts of a marginal area of the mounting plate surrounding the hotplate transparent component means, being provided in the marginal area having light entry and exit surfaces situated at the underside and upperside respectively of the mounting plate and which transparent component means are constructed as a separate part surrounding the hotplate.

12. An electric cooking means according to claim 11, wherein the transparent components means include a sealing ring made from transparent, heat-resistant material of a group comprising elastic material and glass, the ring being located between a sheet metal trim ring and the mounting plate.

13. An electric cooking means according to claim 11, wherein at least two substantially round electric hotplates are fitted in closely adjacent manner in an adaptor means, which in turn can be fitted in a mounting plate and is made from a low-distortion, vitreous material, the cooking surfaces of the hotplates being located in a common plane.

14. An electric cooking means according to claim 13, wherein the adaptor means has a oval outer bondary with two circular mounting openings for two hotplates, the hotplates having switching and regulating means, being operable individually and jointly.

15. An electric cooking means according to claim 13, wherein in a circumferential area of the hotplates are provided light passage means and wherein the illuminating means are constructed for indicating different on-states of one or more of said hotplates and separately switchable illuminating means are provided for each hotplate.

16. An electric cooking means comprising:

at least one electric hotplate, having a non-transparent cooking surface;

a mounting plate having at least one recess for receiving the hotplate;

at least one illuminating means being positioned below the mounting plate and having an illuminating chamber and light passage means for illuminating at least parts of a marginal area of the mounting plate surrounding the hotplate, the mounting plate is made from opaque material having an upper surface, and in the marginal area surrounding the hotplate, (a light exit surface of the light passage means), which is located above the surface of the mounting plate and illuminates parts of the mounting plate surface.

17. An electric cooking means comprising:

at least one electric hotplate, having a non-transparent cooking surface;

a mounting plate having at least one recess for receiving the hotplate;

at least one illuminating means being positioned below the mounting plate and having an illuminating chamber and light passage means for illuminating at least parts of a marginal area of the mounting plate surrounding the hotplate, transparent component means being provided in the marginal area having light entry and exit surfaces situated at the underside and upperside respectively of the mounting plate and which transparent component means are constructed as a separate part surrounding the hotplate, wherein the transparent component means include a sealing ring made from transparent, heat-resistant material of a group comprising elastic material and glass, the ring being located between the sheet metal trim ring and the mounting plate, and wherein the ring has a substantially laterally directed light exit surface.

18. An electric cooking means comprising:

at least one electric hotplate, having a non-transparent cooking surface;

a mounting plate having at least one recess for receiving the hotplate;

at least one illuminating means being positioned below the mounting plate and having an illuminating chamber and light passage means for illuminating at least parts of a marginal area of the mounting plate surrounding the hotplate;

the illuminating means containing at least one electric lamp, which illuminates the tray-shaped illuminating chamber and which has an area surrounding with a substantially uniform spacing the hotplate, the illuminating chamber having a socket area in which a socket for the lamp is arranged, the socket for the lamp being provided in an area locating laterally below the hotplate and being directed substantially horizontally towards the hotplate center, the socket being positioned in a socket portion penetrating the tray shape of the illuminating chamber, wherein the illuminating chamber is fitted by means of a snap closure fastening means, which contains positioning elements preventing rotation.

19. An electric cooking means comprising:

at least one electric hotplate, having a non-transparent cooking surface;

a mounting plate having at least one recess for receiving the hotplates;

at least one illuminating means being positioned below the mounting plate and having an illuminating chamber and light passage means for illuminating at least parts of a marginal area of the mounting plate surrounding the hotplate, transparent component means being provided in the marginal area having light entry and exit surfaces situated in the underside and upperside respectively of the mounting plate and which transparent component means are constructed at a separate part surrounding the hotplate, wherein a substantially circular disk-shaped transparent ring is provided in a reception recess of a surrounding mounting plate.

* * * * *